US008024848B2

(12) United States Patent
Carter

(10) Patent No.: US 8,024,848 B2
(45) Date of Patent: Sep. 27, 2011

(54) DOUBLE-ACTION CLINCHING METHOD

(75) Inventor: Jon T. Carter, Farmington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 490 days.

(21) Appl. No.: 12/247,983

(22) Filed: Oct. 8, 2008

(65) Prior Publication Data

US 2010/0083483 A1 Apr. 8, 2010

(51) Int. Cl.
*B21D 39/00* (2006.01)

(52) U.S. Cl. ..... 29/432; 29/432.1; 29/432.2; 29/505; 29/509; 29/521; 29/798; 29/243.5; 403/283; 403/285

(58) Field of Classification Search ..... 29/432, 29/432.1, 432.2, 505, 509, 521, 798, 243.5; 403/282, 283, 285
See application file for complete search history.

(56) References Cited

U.S. PATENT DOCUMENTS 1,252,289 A * 1/1918 Murray, Jr. ..... 219/149
3,771,216 A * 11/1973 Johnson ..... 29/509
3,934,327 A 1/1976 Hafner
4,306,511 A 12/1981 Ashby et al.
4,584,753 A * 4/1986 Eckold et al. ..... 29/243.5
4,660,403 A * 4/1987 Slasinski ..... 72/389.1
4,897,912 A * 2/1990 Slasinski ..... 29/432.2
4,916,798 A * 4/1990 Ballast ..... 29/432
5,203,812 A 4/1993 Eckold et al.
5,259,102 A 11/1993 Obrecht
5,722,139 A 3/1998 Ladouceur et al.
7,065,854 B2 6/2006 Gerfast

* cited by examiner

*Primary Examiner* — Jermie Cozart
(74) *Attorney, Agent, or Firm* — Dierker & Associates, P.C.

(57) ABSTRACT

Double-action clinching includes establishing a first layer on a second layer, and securing the layers between a tool's punch and clinching punch. First layer has less ductility than second layer, and clinching punch diameter is smaller than punch diameter. Layers are secured so: a tool support receives a portion of a second layer surface; clinching punch, slidably positioned in the support, is adjacent another portion of the second layer surface; and punch, positioned opposed to clinching punch, is adjacent a portion of a first layer surface. Pressing the punch into the first layer surface portion forms an aperture through the first layer. Pressing the clinching punch, in a direction opposite to the punch pressing, into the other portion of the second layer surface forces portion(s) of the second layer into the aperture, and forms a micro-interlocking flush-back joint between an aperture side wall and the second layer portion(s).

11 Claims, 1 Drawing Sheet

DOUBLE-ACTION CLINCHING METHOD

TECHNICAL FIELD

The present disclosure relates generally to a double-action clinching method and a tool for performing the same.

BACKGROUND

Materials may be secured together using many different methods, including, for example, hot clinching and friction stir spot welding. Hot clinching techniques often result in the thermal expansion of the materials, while friction stir spot welding often results in brittle phase formation when joining different materials (e.g., aluminum and magnesium). Other clinching techniques may require the precise alignment of the clinching tool with particular features of the materials to be clinched and/or may result in the splitting or cracking of the clinch button.

SUMMARY

A double-action clinching method includes establishing a first layer on a second layer, where the first layer has less ductility than the second layer. The first and second layers are secured between a punch and a clinching punch of a double action clinching tool such that: i) a support of the tool receives a portion of a surface of the second layer, and ii) the clinching punch slidably positioned in the support is adjacent to another portion of the surface of the second layer; and the punch, positioned opposed to the clinching punch, is adjacent to a portion of a surface of the first layer. The punch has a first diameter, and the clinching punch has a second diameter that is smaller than the first diameter. The punch is pressed into the portion of the surface of the first layer, thereby forming an aperture through the first layer. The clinching punch is pressed into the other portion of the surface of the second layer in a direction opposite to the pressing of the punch, thereby forcing at least a portion of the second layer into the aperture and forming at least a flush-back joint with micro-interlocking between a side wall of the aperture and the at least the portion of the second layer.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figures 1A, 1B, 1C, 1D, 1E:
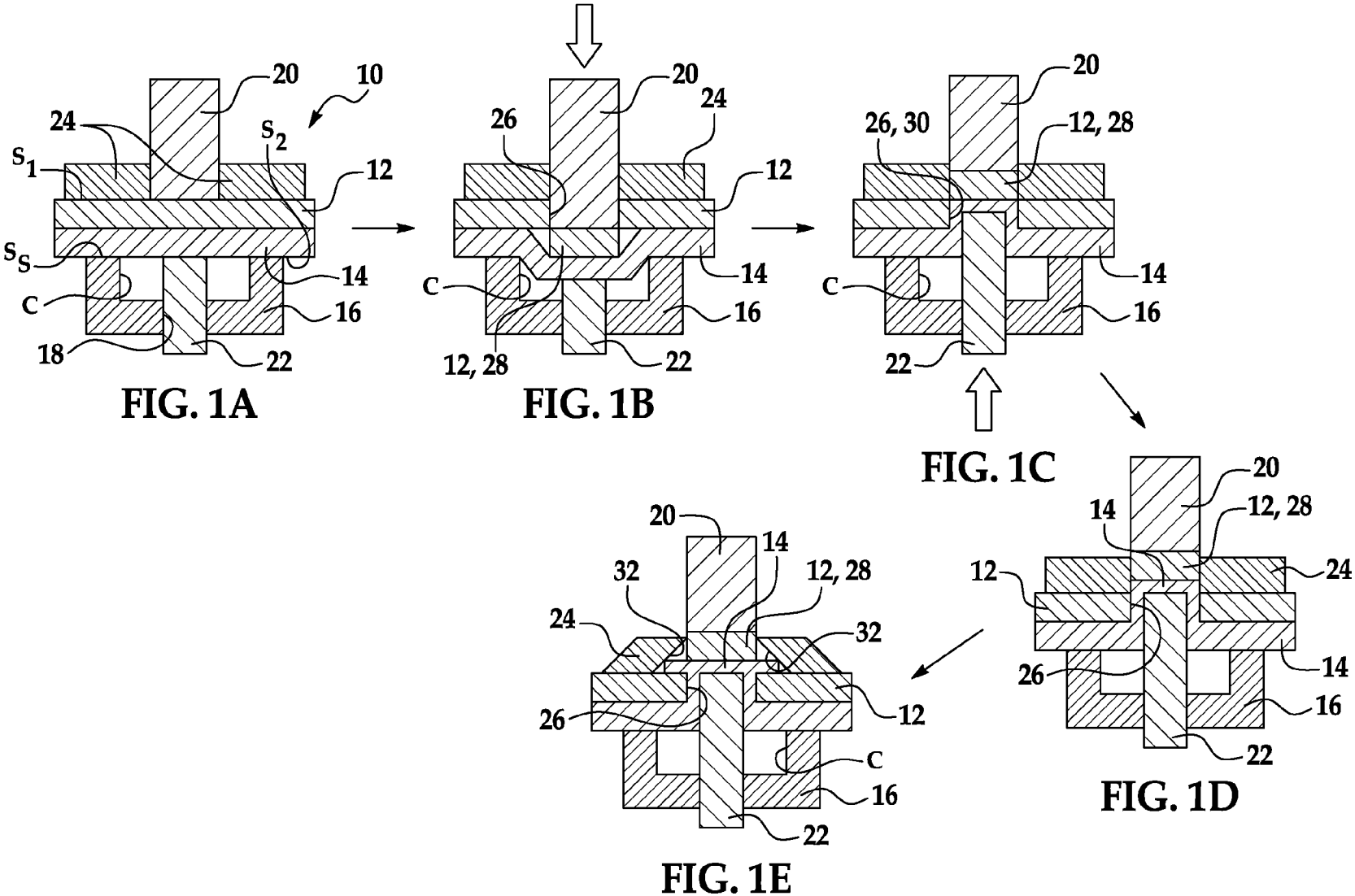
FIGS. 1A through 1E together schematically illustrate an example of the double-action clinching method to form a flush-back joint with micro-interlocking (FIGS. 1C-1E) and a button-back joint with macro-interlocking (FIG. 1E).

Embodiments of the double-action clinching method disclosed herein advantageously enable the formation of a mechanical joint with interlocking at the microscopic level or at microscopic and macroscopic levels. The method clinches overlapping sheets of material, but does not require precise alignment of the clinching tool with any particular area (e.g., a preformed aperture) of the sheets. Furthermore, it is believed that because the method pierces an aperture in one of the materials (instead of both materials), the resulting joint is watertight.

Referring now to FIG. 1A, a schematic illustration of a double-action clinching tool 10 is depicted having first and second layers 12, 14 secured therein. The tool 10 includes a support 16 having an aperture 18 formed therein. The support 16 also includes a surface $S_S$ that receives and supports the layers 14, 12 during the operation of the tool 10. In a non-limiting example, the support 16 is made from hardened tool steel. It is to be understood that the second layer 14 may be positioned on the support 16, and then the first layer 12 may be established thereon; or the first layer 12 may be established on the second layer 14 and then the stack of layers 12, 14 may be positioned on the support 16.

The first and second layers 12, 14 are, in an embodiment, preformed sheets or components such as, for example, preformed automotive body parts (e.g., fenders and reinforcing panels). It is to be understood, however, that the layers 12, 14 may otherwise be formed into a particular component after they are joined together.

One layer 12 overlies at least a portion of the other layer 14 at least at an area where it is desirable to join the two layers 12, 14 together. In some instances, the first layer 12 will completely overlie the second layer 14, and in other instances, the first layer 12 will partially overlie the second layer 14. The first layer 12 (i.e., the layer that will receive a punch 20, described further hereinbelow) is generally less ductile than the second layer 14 (i.e., the layer that will receive a clinching punch 22, described further hereinbelow). As used herein, "ductility" is expressed in terms of percent (%) elongation achieved when a strip sample is pulled to failure in a uni-axial tensile test at room temperature. For the double-action clinching process disclosed herein, it is believed that desirable ductility values are as follows: the first layer 12 has less than 20% elongation and the second layer 14 has more than 30% elongation. It is to be understood, however, that the ductility of the layers 12, 14 may vary depending, at least in part, on the tool design and desired workpiece thickness.

Non-limiting examples of the first layer 12 include magnesium alloyed with at least aluminum and zinc such as, e.g., Magnesium Alloy AZ31B and AZ91D. Non-limiting examples of the second layer 14 include aluminum alloyed with magnesium such as, e.g., Aluminum Alloy 5754 and Aluminum Alloy 5083.

The tool 10 further includes the previously mentioned punch 20 and clinching punch 22. In a non-limiting example, the punch 20 and the clinching punch 22 are both made from hardened tool steel. The clinching punch 22 is slidably positioned in the support aperture 18, and the punch 20 is positioned opposite to the clinching punch 22. In one example, both the punch 20 and the clinching punch 22 have a circular cross section, but the diameter of the punch 20 is larger than the diameter of the clinching punch 22. In an example, the diameter of the punch 20 ranges from about 10 mm to about 50 mm, and the diameter of the clinching punch 22 ranges from about 8 mm to about 48 mm. It is to be understood, however, that the diameter of the punch 20 and the clinching punch 22 may be selected based on several factors including, for example, the thickness of the layers 12, 14, a desired strength of the joint between the layers 12, 14, the amount of space or overlap available on the layers 12, 14, and combinations thereof. It is to be further understood that the cross sectional shape of the punch 20 and clinching punch 22 may be some shape other than circular, but the diameter (or other suitable measurement) of the punch 20 is always larger than that of the clinching punch 22. For example, if the cross sectional shapes of the punch 20 and clinching punch 22 are square, the respective diameters are the diagonal length of each square. In this example, the diagonal length of the punch 20 would be larger than the diagonal length of the clinching punch 22.

When the layers 12, 14 are positioned in the tool 10, the support 16 receives a portion of a surface $S_2$ of the second layer 14, the clinching punch 22 is adjacent to another portion of the surface $S_2$, and the punch 20 is adjacent to a portion of a surface $S_1$ of the first layer 12. As previously mentioned, the punch 20 and clinching punch 22 are positioned opposite to each other. Such positioning enables the punch 20 (when engaged) to form an aperture (labeled 26 and shown in FIGS. 1B-1E) in a desirable portion of the first layer 12, and enables the clinching punch 22 (when engaged) to force a portion of the second layer 14 back through that aperture 26 (shown in FIGS. 1C through 1E). It is to be understood that the punch 20 and clinching punch 22 may be aligned opposite to each other at any desirable position along the length of the layers 12, 14. Since the punch 20 actually forms the desirable aperture 26 in the first layer 12, the punch 20 and clinching punch 22 do not have to be pre-aligned with any particular portion of the layers 12, 14 (e.g., a pre-existing aperture), except at a portion where it is desirable to clinch the layers 12, 14 together.

The tool 10 also includes a retractable clinching die 24. When the layers 12, 14 are positioned in the tool 10, the retractable clinching die 24 contacts the first layer 12. In addition to being positioned between the punch 20 and clinching punch 22, the layers 12, 14 are also positioned between the retractable clinching die 24 and the support 16. The clinching die 24 generally functions as a stripper ring to facilitate removal of the punch 20 from the first layer 12 (which occurs between FIGS. 1B and 1C). Similarly, the support 16 functions as a stripper ring to facilitate removal of the clinching punch 22 from a flush-back joint (as will be described below in connection with FIG. 1C) or a button-back joint (as will be described below in connection with FIG. 1E), depending upon which joint is formed.

Referring now to FIG. 1B, in an example of the double-action clinching method, the punch 20 is pressed into the surface $S_1$ of the first layer 12. At least in part because of the substantially low ductility of the first layer 12, the punch 12 is able to form an aperture 26 therethrough.

A slug 28 of the first layer 12 is displaced from the first layer 12 when the aperture 26 is formed therein. The slug 28 may be removed from the tool 10 and workpiece area upon completion of pressing the punch 20 and pressing the clinching punch 22 (described further hereinbelow). In one example, the slug 28 is pushed away from the layers 12, 14 as a result of the pressing of the clinching punch 22 into the second layer 14. The slug 28 may be trapped between the punch 20 and the flush-back joint (shown in FIG. 1C), or between the punch 20 and the button-back joint (shown in FIG. 1E), depending on which joint is formed. After the desirable joint is fully formed, the slug 28 may be removed. As such, in some instances, the slug 28 is removed after the flush-back joint is formed, and in other instances, the slug is removed after the button-back joint is formed. In still other instances, both joints may be formed, and the slug 28 may be removed after forming the flush-back joint (FIG. 1C) and prior to forming the button-back joint (FIGS. 1D and 1E). The slug 28 may, in an example, be removed by a brush or via an air blast process.

With reference now to FIG. 1B, when the aperture 26 in the first layer 12 is formed, the second layer 14 stretches, but remains intact (i.e., an aperture is not formed in the second layer as a result of this process).

As shown in the Figures, one end of the support aperture 18 opens into a cavity C that is configured with a diameter and a depth that are large enough to receive the slug 28 and the portion of the second layer 14 that stretches when the punch 20 is engaged. As such, the dimensions of the cavity C depend, at least in part, on the diameters and shapes of punches 20, 22, and the thicknesses of the layers 12, 14. Furthermore, since the support aperture 18 opens into the cavity C, the clinching punch 22 may extend through the cavity C when it is engaged.

After the aperture 26 is formed in the first layer 12, the punch 20 is no longer pressed, and the clinching punch 22 is pressed in a direction opposite to the direction in which the punch 20 is pressed. As shown in FIG. 1C, the clinching punch 22 is pressed into at least a portion of the surface $S_2$ of the second layer 14 that has been stretched due to the action of the punch 20. Pressing the clinching punch 22 is continued at least until the slug 28 is forced back through the aperture 26 and a portion of the second layer 14 is forced back into the aperture 26.

As shown in FIG. 1C, the clinching punch 22 is pressed at least until the aperture 26 is filled with the second layer 14. This forms the flush-back joint (as referenced above) with micro-interlocking between the side wall(s) 30 of the aperture 26 and the portion(s) of the second layer 14 now adjacent such side wall(s) 30. The method may include stopping the pressing of the clinching punch 22 at this point, thereby preventing the second layer 14 in the aperture 26 from extending beyond the aperture 26. If it is desirable to cease the method at this point, the layers 12, 14, clinched via a flush-back joint, are removed from the tool 10.

FIGS. 1D and 1E illustrate an example of the method in which the clinching punch 22 is continued to be pressed such that at least some of the second layer 14 extends beyond the aperture 26 (FIG. 1D) and then onto the surface $S_1$ of the first layer 12 (FIG. 1E). The second layer 14 initially extends onto the areas of the surface $S_1$ that are adjacent the aperture 26, and then moves laterally across the surface $S_1$. Generally, the more the clinching punch 22 is pressed, the further the portion of the second layer 14 extends across the surface $S_1$. The presence of the second layer 14 through the aperture 26 and on the surface $S_1$ of the first layer 12 forms the button-back joint (as referenced above) with macro-interlocking between the two layers 12, 14.

As shown in FIG. 1E, the laterally moving portions of the second layer 14 may contact the interior wall(s) 32 of the retractable clinching die 24. The lateral movement of the second layer 14 pushes the interior wall(s) 32 such that it is angularly offset from its initial position (which is shown in FIGS. 1A through 1D). The initial position of the clinching die interior wall(s) 32 is substantially perpendicular to the surface $S_S$ of the support 16 and/or the surface $S_1$ of the first layer 12. Since the surface $S_S$ of the support 16 and/or the surface $S_1$ of the first layer 12 is generally horizontal (i.e., at 0°), the initial position of the clinching die interior walls(s) 32 is about 90°. As used herein, the term substantially perpendicular means that the initial position is 90° plus or minus 5° from the surface $S_S$ and/or the surface $S_1$. In some instances, the initial position of the clinching die interior walls(s) 32 is about 90° plus or minus 10° from the surface $S_S$ and/or the surface $S_1$. It is to be understood, however, that the probability of the final workpiece cracking increases as the initial position of the clinching die interior walls(s) 32 varies from 90°.

When the layer 14 contacts the interior walls(s) 32, the die 24 shifts such that one area of the interior walls(s) 32 continues to contact the punch 20, while the other area of the interior walls(s) 32 is pushed radially outward from the punch 20.

Once the desirable amount of the second layer 14 flows onto the surface $S_1$, the clinching punch 22 is no longer pressed. The clinched layers 12, 14 may then be removed from the tool 10.

The punch 20, the clinching punch 22, and the support 16 are retracted axially away from the layers 12, 14. This allows the joined layers 12, 14 to be laterally removed from the tool 10. When the retractable clinching die 24 retracts, the walls 32 return to the initial position, and the tool 10 is ready to receive other layers 12, 14.

While several embodiments have been described in detail, it will be apparent to those skilled in the art that the disclosed embodiments may be modified. Therefore, the foregoing description is to be considered exemplary rather than limiting.

The invention claimed is:

1. A double-action clinching method, comprising:

establishing a first layer on a second layer, the first layer having less ductility than the second layer;

securing the first and second layers between a punch and a clinching punch of a double-action clinching tool such that:

i) a support of the tool receives a portion of a surface of the second layer, and ii) the clinching punch slidably positioned in the support is adjacent to an other portion of the surface of the second layer; and the punch, positioned opposed to the clinching punch, is adjacent a portion of a surface of the first layer, wherein the punch has a first diameter, and the clinching punch has a second diameter that is smaller than the first diameter;

pressing the punch into the portion of the surface of the first layer, thereby forming an aperture through the first layer; and then pressing the clinching punch into the other portion of the surface of the second layer in a direction opposite to the pressing of the punch, thereby forcing at least a portion of the second layer into the aperture and forming at least a flush-back joint with micro-interlocking between a side wall of the aperture and the at least the portion of a second layer.

2. The double-action clinching method as defined in claim 1 wherein forming the aperture forms a single slug of the first layer, and wherein pressing the clinching punch removes the single slug from the first and second layers.

3. The double-action clinching method as defined in claim 1, further comprising stopping the pressing of the clinching punch before the at least the portion of the second layer extends onto the surface of the first layer.

4. The double-action clinching method as defined in claim 1, further comprising continuing to press the clinching punch such that at least some of the at least the portion of the second layer in the aperture extends onto the surface of the first layer, thereby forming a button-back joint with macro-interlocking between the first and second layers.

5. The double-action clinching method as defined in claim 4 wherein pressing the clinching punch is continued until the at least the portion of the second layer extending onto the surface of the first layer contacts an interior wall of a clinching die that is contacting the first layer, and pushes the clinching die interior wall such that it is angularly offset from its initial position.

6. The double-action clinching method as defined in claim 5 wherein the initial position of the clinching die interior wall is substantially perpendicular to the surface of the first layer.

7. The double-action clinching method as defined in claim 4 wherein the button-back joint is water-tight.

8. The double-action clinching method as defined in claim 1 wherein the second layer stretches, but remains intact, during the formation of the aperture in the first layer.

9. The double-action clinching method as defined in claim 1 wherein the punch and clinching punch are aligned at any position along the respective surfaces of the first and second layers.

10. The double-action clinching method as defined in claim 1 wherein the flush-back joint is water-tight.

11. The double action clinching method as defined in claim 1 wherein the ductility of the first layer is less than 20% elongation, and wherein the ductility of the second layer is greater than 30% elongation.

* * * * *